United States Patent [19]

Osher et al.

[11] Patent Number: 4,651,367

[45] Date of Patent: Mar. 24, 1987

[54] COLLAPSIBLE BABY CRIB

[75] Inventors: John D. Osher; Thomas Rattray, both of Cincinnati, Ohio

[73] Assignee: Gerber Products Company, Fremont, Mich.

[21] Appl. No.: 599,636

[22] Filed: Apr. 12, 1984

[51] Int. Cl.[4] ..... A47C 29/00

[52] U.S. Cl. ..... 5/99 R; 5/99 A

[58] Field of Search ..... 5/93 R, 98 R, 99 R, 5/99 A, 102

[56] References Cited

U.S. PATENT DOCUMENTS

| | | | |
|---|---|---|---|
| 2,601,111 | 6/1952 | Foster | 5/99 A |
| 3,183,528 | 5/1965 | Jacobs et al. | 5/99 R |
| 3,206,772 | 9/1965 | Sarasin | 5/98 |
| 3,606,620 | 9/1971 | Glover | 5/99 R |
| 3,631,548 | 1/1972 | Dahab | 5/99 R |
| 3,703,670 | 9/1973 | Landry | 5/99 R |

FOREIGN PATENT DOCUMENTS

| | | | |
|---|---|---|---|
| 1131696 | 2/1957 | France | 5/99 R |
| 595507 | 12/1947 | United Kingdom | 5/99 A |

*Primary Examiner*—Gary L. Smith
*Assistant Examiner*—Michael F. Trettel
*Attorney, Agent, or Firm*—Townsend and Townsend

[57] ABSTRACT

A collapsible baby crib having two pairs of opposed end legs, two centrally-located side legs, the legs being pivotally interconnected by upper and lower horizontal tubes, and covered by a fabric to form a generally rectangular crib which can be zig-zag folded to a collapsed condition. Two floor halves in the lower portion of the crib form a bottom wall. Each floor half is formed of a generally triangular section, the two triangular sections being hinged together along a diagonal line. One triangular section is hinged to an end tube and one triangular section is hinged to a side tube. The floor is folded within the confines of the crib walls when in collapsed condition.

19 Claims, 11 Drawing Figures

COLLAPSIBLE BABY CRIB

This invention relates to a baby crib, and more particularly, the invention relates to a baby crib having four walls and hinged floor members which permit the crib to be erected and collapsed.

BACKGROUND OF THE INVENTION

Baby cribs are old and well known. The most widely used crib is a rigid four-wall structure standing on four legs, one of the walls being vertically slidable so as to permit easy access to the baby. That crib is not at all portable.

One known portable structure simply has four side walls which are pivoted together and is provided with straps so that it can be strapped to a normal size bed to provide a temporary confined area for a baby to sleep.

Another known portable crib has a drop side which must be fixed with care in its erect position, for if it drops inadvertently, a baby can become entangled in the wall fabric and perhaps become asphyxiated.

None of the known portable cribs combine the attributes of being lightweight, easily erected and easily collapsed.

SUMMARY OF THE INVENTION

It has been an objective of the present invention to provide a crib having at least the following improvements: it is more portable than other cribs on the market; it is lighter in weight than other cribs on the market while still being of rigid construction when erected; it is easy to erect and collapse; and it is reliable and safe.

The objective of the invention is attained by providing four walls consisting of vertical legs and horizontal tubes with a fabric stretched between the horizontal tubes to form the four walls. The upper and lower tubes forming the side walls are pivoted intermediate their ends to create two panels on each side of the crib, the pivoted structure permitting the crib to be zig-zag folded into a collapsed condition.

The crib has two half floors, each formed of two generally triangular sections which are hinged together along a diagonal line. One triangular section is hinged to the lower tubing forming the end wall and the other section is hinged to the lower tubing forming the side wall.

By simply pulling up on the floor panels, the whole crib collapsed into a zig-zag fold with the respective half floors being folded upon themselves and nesting into side panels. Thus, the crib can be erected or collapsed in a matter of just a few seconds.

There are several structural features which impart sturdiness to the lightweight structure and which contribute to the reduction of the size of the crib when in collapsed condition.

The side-forming horizontal tubes are positioned lower than the end-forming horizontal tubes so that when collapsed, the side tubes underlie a substantial portion of the end tubes, thereby reducing the thickness dimension of the collapsed package.

The side-forming horizontal tubes are interconnected by an intermediate link which permits the legs to fold upon themselves when the crib is collapsed but to remain in line when the crib is erected. A split tube slide is provided to overlie the links when the crib is erected, thereby further rigidifying the crib.

The horizontal tubes are spaced above the lower ends of the vertical legs and hence the floor halves which are hinged to the horizontal tubes are spaced above the floor. Support posts are mounted on each half floor along the diagonal hinge line between triangular sections. The hinging structure forces the post into a vertical supporting attitude when the floor is in a horizontal position. The posts are permitted to swing to an attitude which is parallel to the triangular sections when the triangular sections are folded upon themselves to the collapsed condition. Thus, the posts provide support for the floor above the ground when the crib is erected and yet do not block the folding of the triangular sections upon themselves when the crib is collapsed.

The hinging of each floor half along a side wall and an end wall leaves a free corner. The free corner is provided with a hook which engages an eye in the side wall to serve the dual functions of supporting the free corners above ground and restraining the side wall from pivoting outwardly.

Elongated split tubes are slidably mounted on the upper side wall-forming tubes. The split tubes can be slid across the pivot between adjoining side-forming tubes to brace the side wall against flexing.

One of the end walls is formed of a two-ply fabric open at the top to create a pocket for a mattress which can be folded and retained in the pocket when the crib is not in use.

BRIEF DESCRIPTION OF THE FIGURES

The objectives and features of the invention will become more readily apparent from the following detailed description taken in conjunction with the accompanying drawings in which:

Referring to FIG. 1, the crib is indicated at 12 and has two pairs of opposed vertical end legs 13 and two opposed vertical side legs 14 and 15. The upper part of the crib is formed by a horizontal frame 18 consisting of opposed end tubes 19 and side tubes 20, 21, 22 and 23. The tubes are pivotally interconnected to form a frame which can be collapsed in zig-zag fashion, as will be described.

Figure 1:
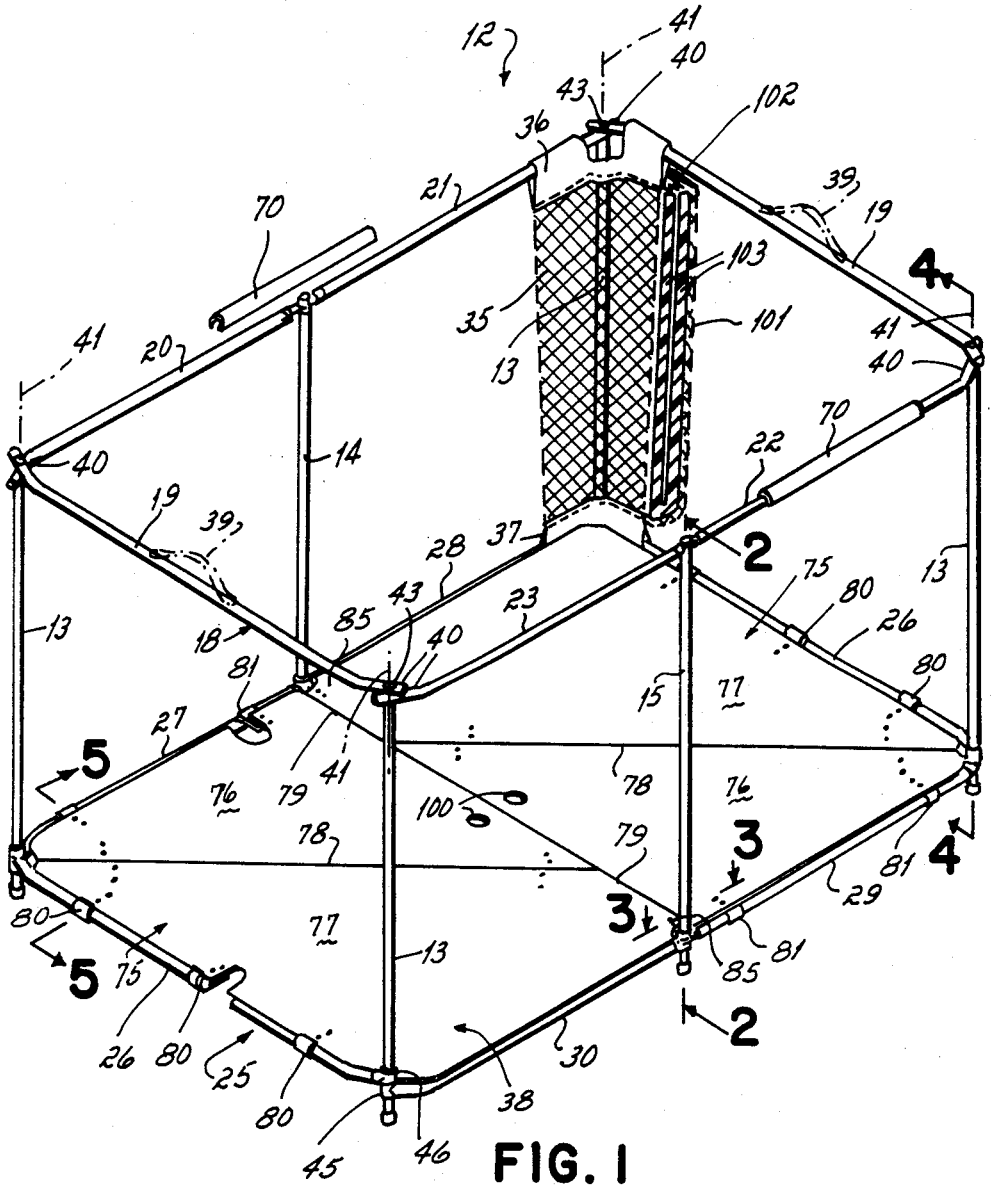
FIG. 1 is a perspective view of the crib of the present invention.

Similarly, a lower horizontal frme 25 is mounted at the lower ends of the legs and consists of a pair of opposed end tubes 26 and side tubes 27, 28, 29 and 30. The tubes of the lower frame are pivotally interconnected so that they too can be collapsed into the zig-zag fold. A fabric 35, preferably a transparent mesh, is secured to the upper and lower horizontal frames. The upper and lower edges of the fabric 35 have plastic sleeves 36 and 37 stitched to it, the sleeves receiving the upper and lower horizontal frames, thereby supporting the fabric on the frames. A fabric strap 39 is connected to each end tube 19 to form a carrying handle. A floor 38 is hinged to the lower frame 25 in a manner which will be described in detail below.

Figure 10:
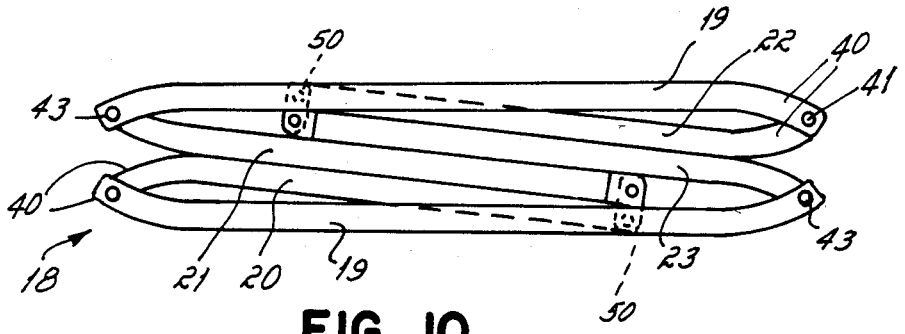
FIG. 10 is a top plan view of the crib in fully collapsed condition.

At the upper and lower corners of the crib, the ends 40 of the horizontal tubes are bent or offset inwardly and are pivotally connected to the legs 13 along pivot axes 41 through the center of the legs. The amount of offset is approximately one and one-half times the diameter of the tube and facilitates the collapsing of the frame into a tight package, as shown in FIG. 10. At each top corner, the tubes are simply pivotally connected to the upper ends of the legs 13 by a bolt 43 which is threaded into a nut 44, the nut being secured to the tubing forming the leg by peening the tube into the nut. At the lower corners the tubes forming the frame 25 are connected to nylon sleeves 45 and 46 spaced above the bottom of the legs, each sleeve having a lug 47 which is inserted into the tube and secured as by swaging the tube into the nylon. Upper and lower retaining rings 49 are positioned onto the lower end of each vertical lug at predetermined distances from the end of each leg and support the sleeves 45 and 46 from sliding upwardly and/or downwardly.

As can be seen from FIG. 1, the side tubes 20–23 are pivoted below the end tubes 19 of the upper frame and the side tubes 27–30 are pivoted under the end tubes 26 of the lower rectangular frame. This relationship also contributes to the formation of the thin, collapsed package, for the side tubes will in part underlie the end tubes when the crib is in collapsed condition as shown in FIG. 10.

Figure 11:
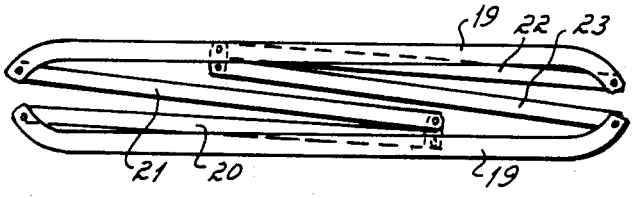
FIG. 11 is a top plan view similar to FIG. 10 of an alternative structure.
Figure 7:
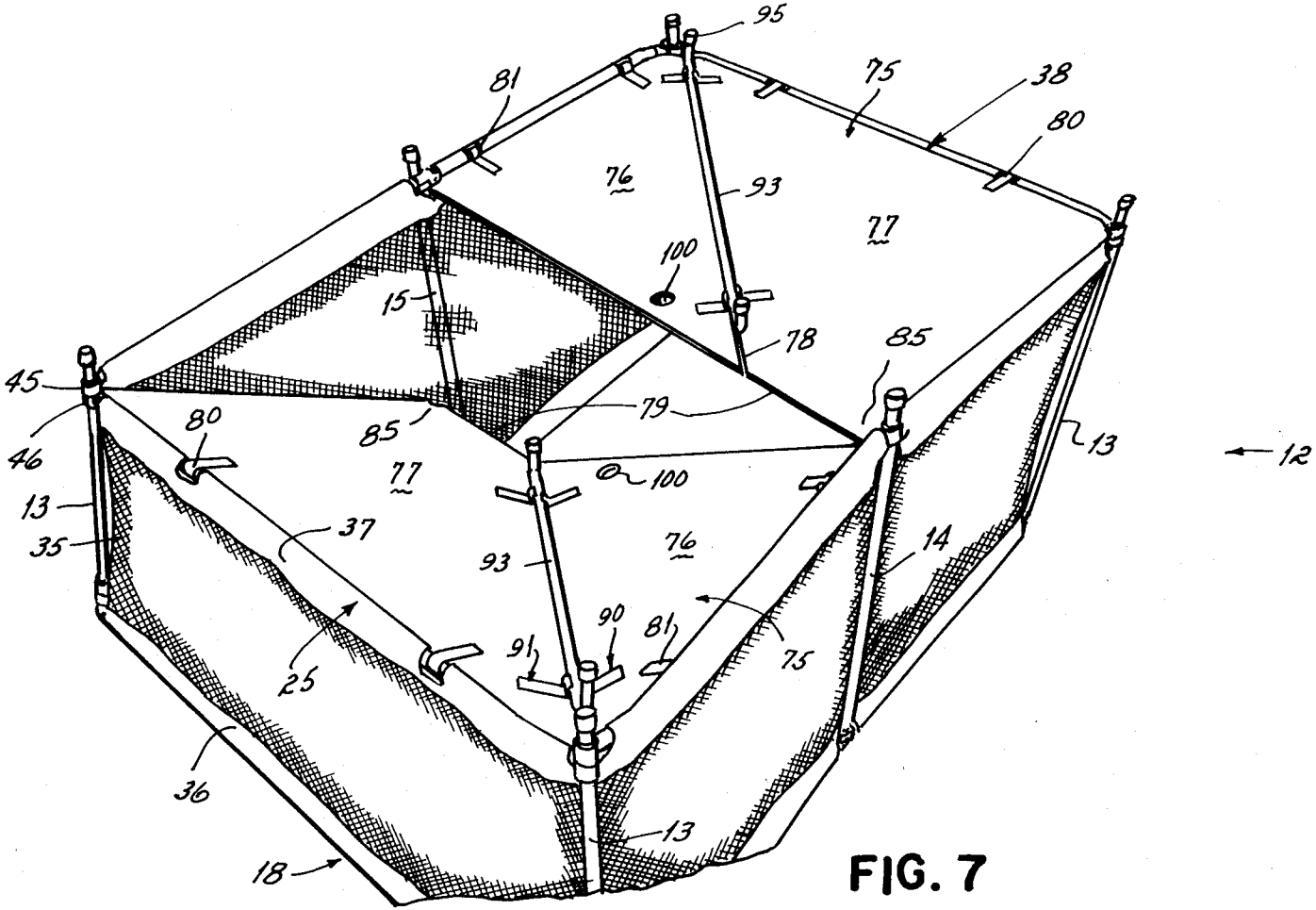
FIG. 7 is a perspective view of the underside of the crib in a partially-collapsed condition.

In the alternative form of FIG. 11, the side tubes 20–23 are straight and all of the offsetting bend is put in the ends of the end tubes 19 so as to provide the tightly-collapsed package.

Figure 2:
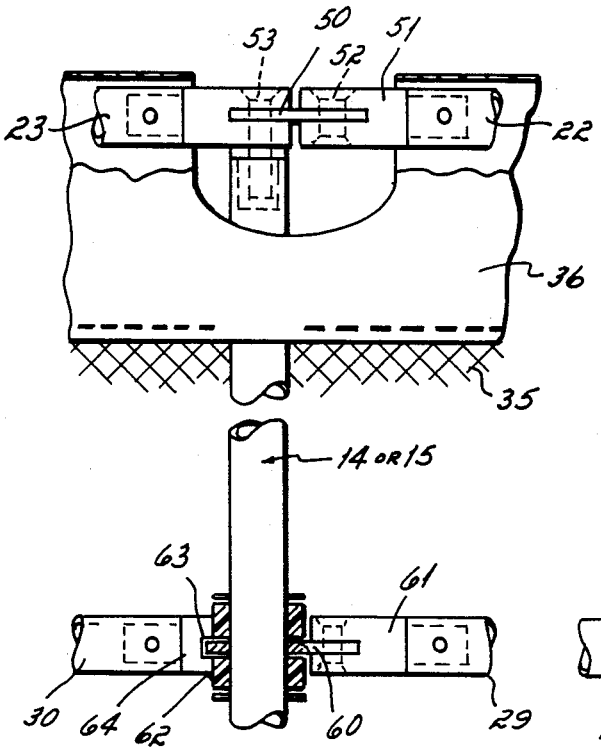
FIG. 2 is a cross-sectional view taken along lines 2—2 of FIG. 1 showing the construction of side central legs and the attachment of the horizontal tubes to it.
Figure 4:
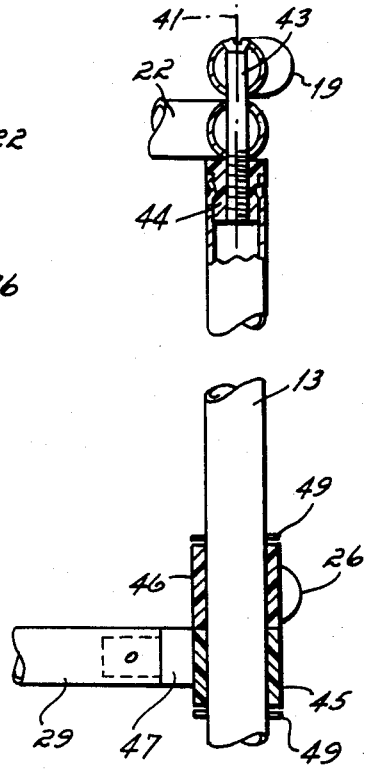
FIG. 4 is a cross-sectional view taken along lines 4—4 of FIG. 1 showing an end corner structure.

The upper side tubes 20, 21 and 22, 23 are pivotally interconnected by means of an intermediate link 50. To mount the link 50, a clevis 51 is inserted into the end of each side tube and the tube is swaged into the clevis to secure it there. (FIG. 2). A rivet 52 pivotally secures one end of the link 50 to a clevis and a screw 53 pivotally secures the other end of the link 50 to the other tube and also secures the clevis to the vertical side leg 14 or 15. The intermediate link 50 permits the upper side tubes to fold upon themselves 180° when the crib is collapsed.

Figure 3:
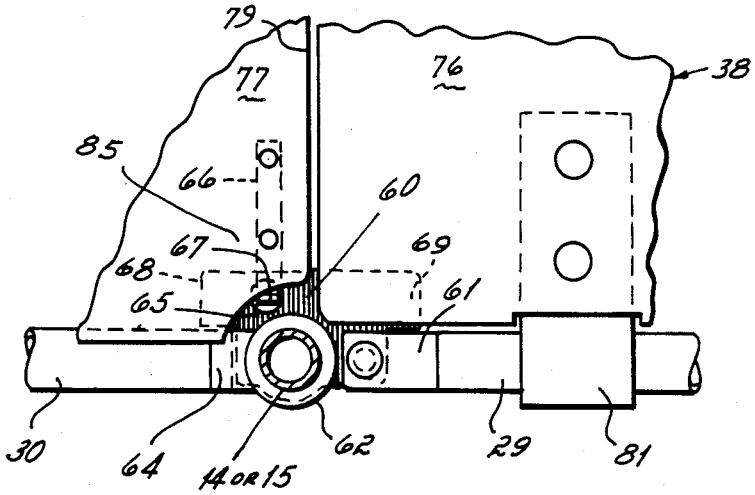
FIG. 3 is a cross-sectional view taken along lines 3—3 of FIG. 1 showing the structure of the joint at the lower central portion of the crib.

As shown in FIGS. 2 and 3, a somewhat similar structure pivotally interconnects the bottom side tubes. An intermediate link 60 is pivotally mounted to a clevis 61 which is secured as above to a bottom side tube 29. The other side of the link 60 has a hole through which the leg 15 passes. The link is vertically captures in a nylon sleeve 62 having transverse slot 63 therein and through which the leg 15 passes. The sleeve has a lug 64 which is inserted into and secured to a tube 30 by swaging. The lower intermediate hinge 60 has a hole 65 forming part of a latch with the floor 38, one section of the floor having an L-shaped bracket 66 terminating in a lug 67 which projects into the hole. The lug 67 projecting into the hole of the link 60 permits the floor to rest upon the link 60 and holds the lower tubes from swinging away from the floor which would permit the floor to droop to the ground. The positions of the lug and hole can be reversed by placing a pin on the hinge 60 and a hole in the corner of the floor.

The link 60 has extensions 68 and 69 against which the lower side tubes will butt to prevent their swinging beyond 180°. Preferably, the extensions prevent swinging beyond 175° to put a slight tension on the frame and offset the natural resilience of the tubing which would let the side joint flex slightly beyond 180°. This design tends to prevent the floor dropping through the frame when the crib is erected.

At each side of the crib, a split tube 70 is slidably-mounted over the upper side tubes and sandwich the plastic sleeves 36 therebetween. When the split tube is slid over the intermediate links 50 as shown above leg 14 in FIG. 1, the side tubes are prevented from pivoting with respect thereto, thereby rigidifying the crib.

The floor 38 is formed of two floor halves. Each floor half 75 is formed of two generally triangular sections 76 and 77. The triangular sections 76 and 77 are hinged together along a diagonal line 78 which lies at about 45° to the respective end and side tubes 26, 27 and 26, 29. Because the floor halves are not perfectly square, each triangular section 77 is truncated at 79 along the center of the crib.

At each end of the crib, the triangular section 77 is hinged by hinge members 80 to a lower end tube 26 and is suspended somewhat lower than the tube 26. The companion triangular section is hinged by hinges 81 to a side tube 27 or 29, the hinges being oriented so that the triangular 76 rests upon the tube 27 or 29. This difference in hinging at 80 and 81 is required because the side tubes 27, 29 are lower than the end tubes 26. (See FIG. 5) The hinging of the triangular sections 76, 77 leaves a free corner 85 in each floor half. It is that free corner which is supported on the lower intermediate link 60 as shown and described in connection with FIGS. 2 and 3 above.

Thus, the pivot axes for the two triangular sections on end tubes and side tubes, respectively, are not in the same plane. Since the floor must fold up flatly and vertically to form the thinnest sandwich possible, it is necessary that the distance from the 45° dividing line 78 to the end tube hinge be shorter than the distance to the side tube hinge by an amount equal to the vertical offset between the end and side tubes. As a consequence, the dividing line does not intersect the corners of the crib exactly.

Figure 5:
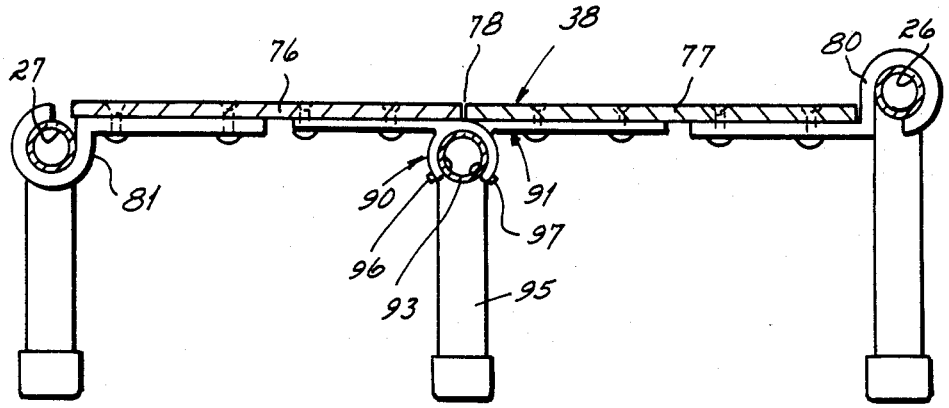
FIG. 5 is a cross-sectional view taken along lines 5—5 of FIG. 1.
Figure 6:
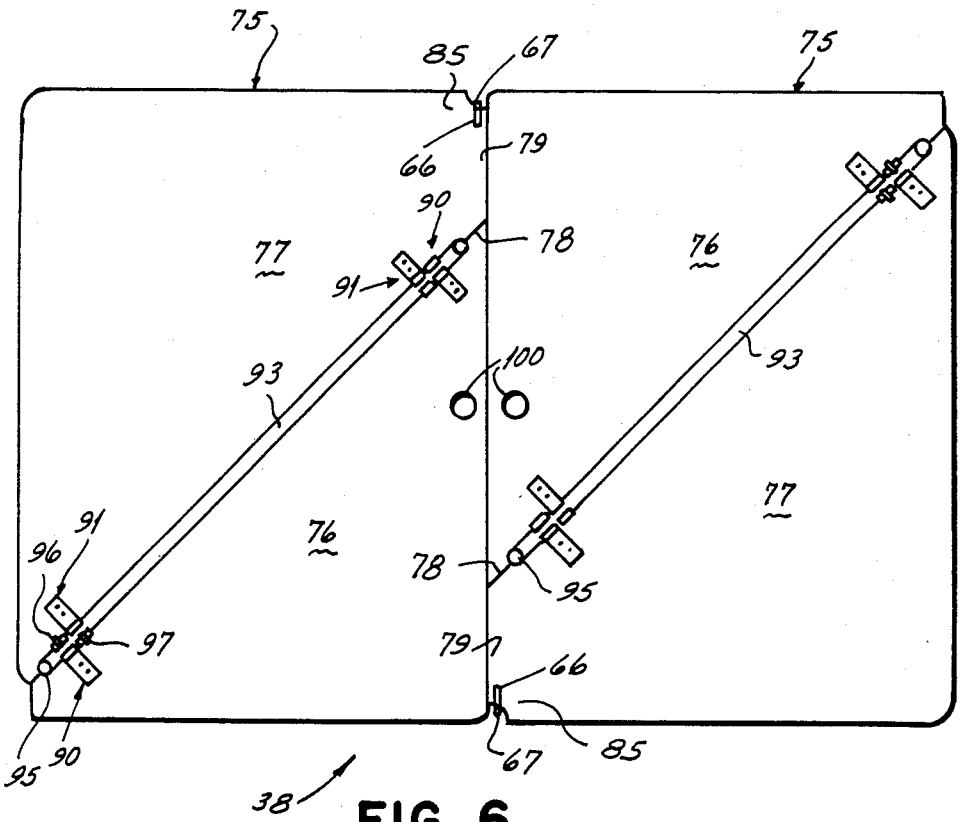
FIG. 6 is a bottom plan view of the floor structure.

The hinging of the triangular sections 76, 77 along the diagonal line 78 can be best understood with reference to FIGS. 5 and 6.

On the undersurface of each triangular section a pair of split nylon sleeves or clips 90, 91 are secured by arms 92 integral with the split sleeves. The arms 92 are riveted to the respective triangular section. A tube 93 is rotatably-mounted in the split sleeves 90, 91. Each tube 93 is terminated in depending posts 95. By being rotatably-mounted in the split sleeves, the posts 95 can pivot to a vertical attitude perpendicular to the floor 38 and provide support for it, or it can rotate to a position lying flat against the triangular sections when the triangular sections are folded upon one another to collapse the crib. At each pair of split sleeves 90, 91, the tube 93 has radially outwardly-projecting pins 96, 97 which form a lost motion connection with their respective clips 90, 91. When the floor is horizontal as viewed in FIG. 5, the pins bear against the respective sleeves 90, 91 and the posts are prevented from assuming a position other than that perpendicular to the floor 38. When the triangular sections are folded upon themselves, the split sleeves rotate out of the way of the pins, thereby permitting the post to swing to a position parallel to the triangular sections. Instead of split sleeves, slotted sleeves could be used to provide the lost motion connection.

As can be seen from FIG. 1, each floor half has a hole 100 by which the floor halves may be raised to begin the collapse of the crib.

It can be also be observed from FIG. 1 that at one end of the crib, an extra ply of fabric 101 is secured across the end of the crib to form a pocket 102. A mattress 103 is folded upon itself and is inserted in the pocket when it is not in use and the crib is to be collapsed.

OPERATION

In operation, let it be assumed that the crib has been erected and is in the condition shown in FIG. 1. The mattress has been folded upon itself and inserted in the pocket 102.

The split tubes are slid from the position overlying the intermediate link at the center of the side walls to an inoperative position such as is shown in the lower right-hand corner of FIG. 1.

Figure 8:
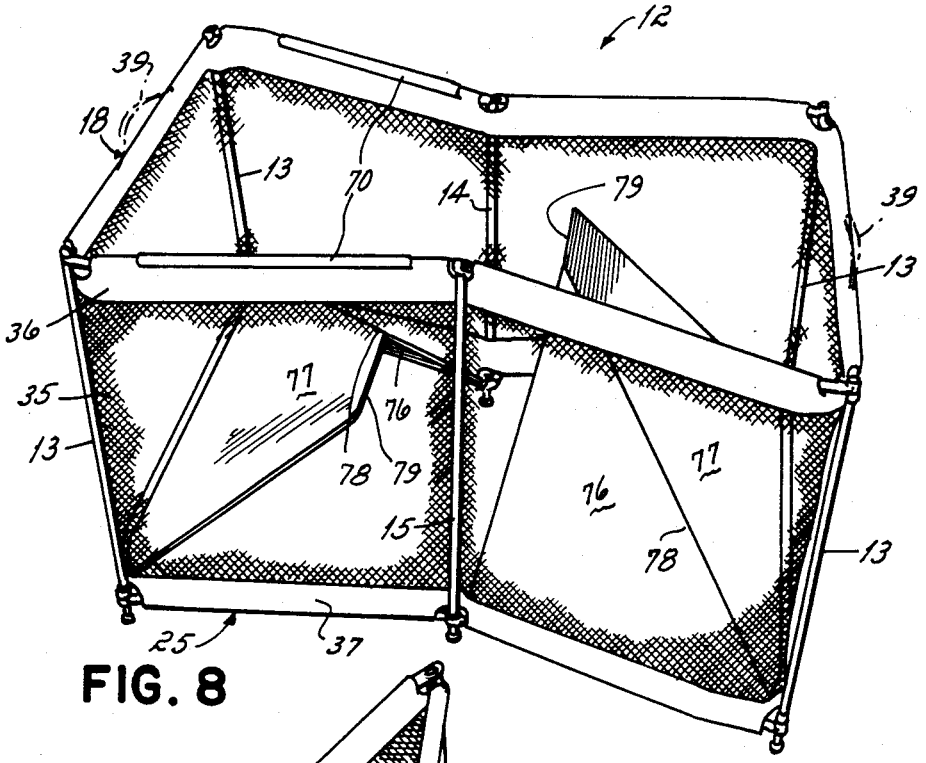
FIG. 8 is a perspective view of the crib in a more completely collapsed condition.
Figure 9:
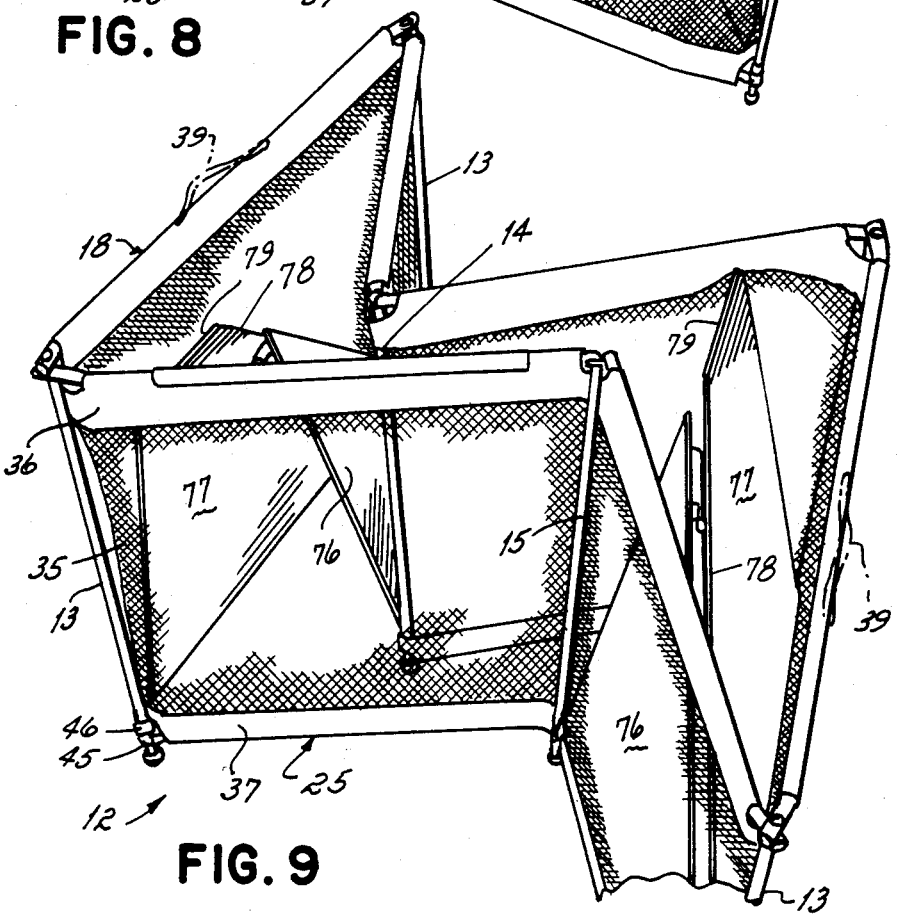
FIG. 9 is a perspective view of a more completely collapsed condition.

Fingers are placed in the two holes 100 to lift the respective floor halves. As the floor halves are lifted, the triangular sections will tend to swing together. As the triangular sections wing together, they draw diagonally-opposed side panels toward the respective end panels and cause the side legs 14 and 15 to swing toward each other, as shown in FIG. 8. Continued movement of the triangular sections toward each other causes the panels to assume the attitude shown in FIG. 9 which brings the crib approximately halfway to the point of a complete zig-zag fold. Thereafter, pushing the end walls toward each other completes the zig-zag fold.

In the folded attitude, the floor halves are tucked between the end wall and the respective side panels. The posts have been permitted to swing to a position parallel to the triangular sections and are sandwiched between them. By grasping the two fabric handles 39 at the top of the end panels, the crib is held in the zig-zag collapsed condition and can be conveniently carried. The operation can be completed in as little as four seconds.

The erecting of the crib is also easily performed. The end panels are simply moved away from each other. That action causes the triangular sections to unfold and snap into a flat position at the bottom of the crib. Thereafter, the split tubes are slid to their central position to rigidify the side walls. That operation also can be performed in as little as four seconds.

Having described our invention, we claim:

1. A collapsible crib comprising:

a pair of opposed end walls, a pair of opposed side walls pivotally connected at their ends to said end walls, said side walls being longer than said end walls, each side wall being formed by two side panels pivoted together on a vertical axis at approximately the center of said side wall, a half floor at each end of said crib, each half floor including only two generally triangular sections, a first of the two generally triangular sections pivoted to the lower edge of said end wall and a second of the two generally triangular sections pivoted to the lower edge of the side panel adjacent said end wall, said triangular sections having adjacent edges which are pivoted together, said crib being erectable with said panels aligned so that said walls form a generally rectangular structure and with said half floors lying in a horizontal plane at the bottom of said crib, said crib being collapsible by folding each floor half upon itself and zig-zag folding said walls upon themselves.

2. A collapsible crib as in claim 1 further comprising:

legs supporting the bottom edges of the walls of said crib above ground, and posts connected at the adjacent edges of said triangular sections to support said half floors above ground.

3. A crib as in claim 2 further comprising means for connecting said posts to said triangular section to lie parallel to said triangular sections when said crib is collapsed, and to lie perpendicular to said triangular sections when said crib is erected.

4. A crib as in claim 3, said connecting means comprising:

an elongated rod having said posts mounted on each end, each end of said rod being rotatably-mounted in two clips, each secured to a respective triangular section, said rod having radial pins forming a lost motion connection with respective clips to force said rod to rotate said posts to a perpendicular attitude when each half floor is shifted to a horizontal attitude and to permit said posts to lie parallel to the triangular sections when the crib is collapsed.

5. A collapsible crib as in claim 1 further comprising:

each half floor having a latch engageable with the bottom edge of one of said side wall panels adjacent the axis on which said side wall panels are pivoted together.

6. A collapsible crib as in claim 1 further comprising:

two vertical legs at each end of said crib and two vertical legs at approximately the center of said side walls, end and side horizontal tubes interconnecting said legs in the form of a rectangle at the top and bottom of said crib, at least the end horizontal tubes being offset vertically from said side horizontal tubes to permit collapse of the crib into as thin a configuration as possible with said side tubes underlying portions of said end tubes.

7. A collapsible crib as in claim 6 further comprising:

intermediate links interconnecting the adjacent upper and lower horizontal side tubes, to permit said tubes to double back upon themselves when the crib is collapsed, and means for locking said side tubes in alignment.

8. A crib as in claim 7 in which said locking means comprises a split stiffening tube slidable over said intermediate link and a portion of the adjoining ends of said upper side tubes.

9. A collapsible crib as in claim 6 further comprising, intermediate links interconnecting the adjacent upper and lower horizontal side tubes to permit said tubes to double back upon themselves when said crib is collapsed, the lower intermediate links having longitudinal extensions engageable by the adjacent ends of the lower side tubes to block swinging movement beyond approximately 180°.

10. A collapsible crib as in claim 1 further comprising:

two vertical legs at each end of said crib and two vertical legs at approximately the center of said side walls, end and side horizontal tubes interconnecting said legs in the form of a rectangle at the top and bottom of said crib, an intermediate link interconnecting adjoining ends of said side tube so that each side tube can fold upon itself, each said side legs being connected to said side tube on one of the pivot axes of said intermediate link.

11. A collapsible crib comprising:

four vertical end legs normally disposed in a rectangular pattern, opposed side legs centrally located between opposite end legs, upper and lower end and side tubes pivotally interconnecting said end and side legs to form upper and lower rectangular frames, a fabric mounted between upper and lower frames, thereby forming two end walls and two side walls, each side wall including two side panels pivoted together, floor panels forming a bottom wall for said crib, means for hinging said floor panels to said lower frame to permit them to be collapsed within said crib walls and said crib walls folded upon themselves in zig-zag fashion to provide a thin, portable package, means for forming a pocket in one of said walls, and a mattress disposed in said one wall when said crib walls are folded.

12. A crib as in claim 11 further comprising:

said lower frame being spaced above the lower ends of said legs, latch means mounted on the lower portion of said side legs and floor panels, respectively, to support said floor panels at the level of said lower frame.

13. A crib as in claim 11 in which said floor panels comprise:

a half floor at each end of said crib, each half floor including two generally triangular sections hinged to each other along a diagonal line extending from a corner of said lower frame, one triangular section being hinged to a side tube and the other triangular section being hinged to the adjoining end tube.

14. A crib as in claim 13, said triangular sections being hinged to diagonally-opposed side tubes, further comprising:

an intermediate link pivotally connecting said upper side tubes together, said side legs being connected to respective side tubes on the pivot axis of said intermediate link farther from the side tube to which said respective triangular section is hinged, thereby creating a space between the side and end tubes for said floor panels to nest.

15. A crib as in claim 14 in which said side tubes are vertically offset below said end tubes, said tubes at the corners of said crib being inwardly offset by about one and one-half times the diameter of said tubes to permit said side tubes to lie partially under said end tubes when said crib is collapsed.

16. A crib as in claim 13 further comprising:

said lower frame being spaced above the lower ends of said legs, and posts pivotally secured to said triangular sections along said diagonal lines, means for pivoting said posts to a ground-engaging vertical attitude when said floor panels are horizontal at the bottom of said crib, thereby providing support for the central portion of said floor panels.

17. A crib as in claim 13 in which said side tubes are vertically offset below said end tubes, said tubes at the corners of said crib being inwardly offset by about one and one-half times the diameter of said tubes to permit said side tubes to lie partially under said end tubes when said crib is collapsed.

18. A crib as in claim 13 in which said side tubes are vertically offset below said end tubes, one triangular section hanging from said end tube, the other triangular section resting on said side tube to permit said sections to create a horizontal half floor when said crib is erected.

19. A crib as in claim 18 in which said diagonal hinge line is offset slightly from the adjacent end leg to accommodate the difference in elevation of the lower side tube with respect to the lower end tube.

* * * * *